United States Patent [19]

Mitchell

[11] Patent Number: 4,462,590

[45] Date of Patent: Jul. 31, 1984

[54] INFLATABLE PADDED GAME BALL

[75] Inventor: Mark E. Mitchell, Phelps County, Mo.

[73] Assignee: Figgie International Inc., Richmond, Va.

[21] Appl. No.: 436,011

[22] Filed: Oct. 22, 1982

[51] Int. Cl.[3] ..... A63B 41/08

[52] U.S. Cl. ..... 273/65 E; 273/DIG. 8; 273/65 ED

[58] Field of Search ..... 273/58 BA, 65 R, 65 EB, 273/65 EC, 65 ED, 65 EF, 65 EG

[56] References Cited

U.S. PATENT DOCUMENTS

| | | | |
|---|---|---|---|
| 964,888 | 7/1910 | Turner et al. | 273/65 E |
| 1,597,308 | 8/1926 | Brandt | 273/DIG. 20 |
| 2,221,533 | 11/1940 | Voit et al. | 273/65 E |
| 3,119,618 | 1/1964 | Molitor et al. | 273/65 E |
| 3,506,265 | 4/1970 | Yugi | 273/58 BA |
| 4,239,568 | 12/1980 | Takazawa | 273/58 BA X |

*Primary Examiner*—George J. Marlo

*Attorney, Agent, or Firm*—Senniger, Powers, Leavitt and Roedel

[57] ABSTRACT

An inflatable padded game ball comprising an inner bladder assembly and an outer carcass enclosing the bladder assembly. The carcass comprises an outer cover of relatively tough durable material, padding on the inside of the cover, and a liner on the inside of the padding. The inner bladder assembly comprises an inflatable bladder of an elastic substantially air-impervious material, and a sheath around the bladder for restraining expansion of the bladder when it is inflated thereby to reduce the outward pressure on the carcass and thus increase the dimensional stability of the ball.

22 Claims, 11 Drawing Figures

INFLATABLE PADDED GAME BALL

BACKGROUND OF THE INVENTION

This invention relates generally to inflatable game balls and more particularly to a padded game ball constructed to have greater durability and improved playing characteristics, and to a method for making such a game ball.

While this invention is applicable to game balls of various types, it is especially applicable to footballs. One of the problems associated with standard non-padded footballs is that they are sometimes relatively difficult to grip, as when they become wet or cold. In an effort to alleviate this problem, padding had been placed between the outer cover and the liner of the ball, thereby making the outer surface of the ball softer and more yielding to the touch. However, the addition of such padding necessitates the use of a thinner liner, which has heretofore resulted in a decrease in the strength and durability of the ball. Thus padded footballs have tended to lose their shape relatively quickly.

Reference may be made to U.S. Pat. Nos. 1,597,308 and 3,119,618 for game balls generally relevant to this invention.

SUMMARY OF THE INVENTION

Among the several objects of this invention may be noted the provision of a padded game ball, such a football, which is adapted to hold its shape over a longer period of time; the provision of such a ball which is relatively lightweight and easy to grip for enabling a player to handle the ball with greater facility and dexterity; and the provision of an economical method for making such a ball.

Generally, an inflatable padded game ball of this invention comprises an inner bladder assembly and an outer carcass enclosing the bladder assembly. The carcass comprises an outer cover of relatively tough durable material, padding on the inside of the cover, and a liner on the inside of the padding. The inner bladder assembly comprises an inflatable bladder of an elastic substantially air-impervious material, and a sheath around the bladder for restraining expansion of the bladder when it is inflated thereby to reduce the outward pressure on the carcass and thus increase the dimensional stability of the ball.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
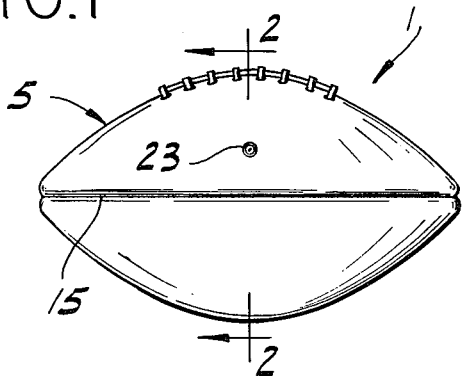
FIG. 1 is a side elevation of a padded football constructed in accordance with this invention.
Figure 3:
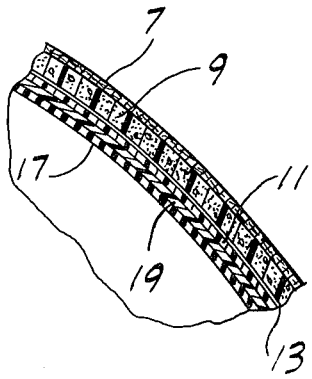
FIG. 3 is a enlarged portion of FIG. 2 showing the wall construction of the football.
Figure 2:
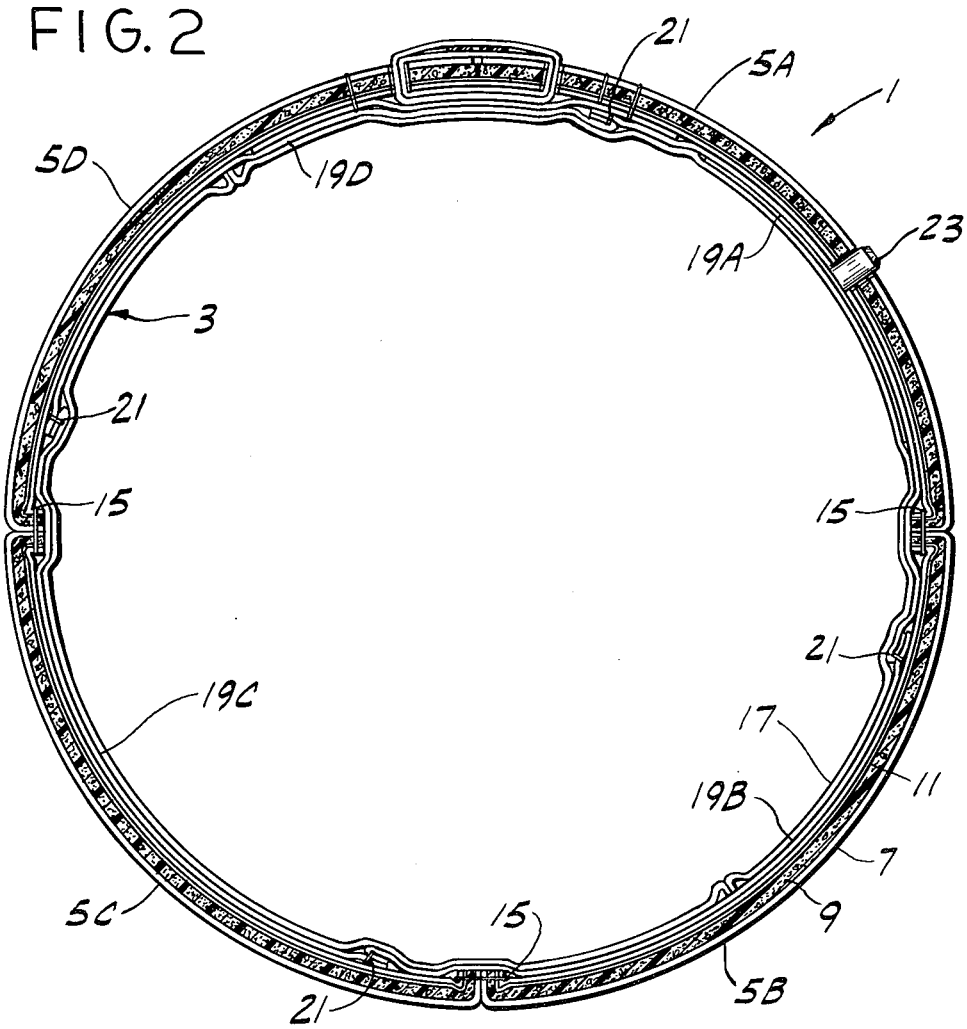
FIG. 2 is a vertical section on line 2—2 of FIG. 1.

Referring now to the drawings, and first more particularly to FIGS. 1–3, there is generally indicated at 1 an inflatable padded game ball of the present invention. The ball depicted in the drawings is a football, but it will be understood that the principles of this invention as hereinafter described are also applicable to other types of game balls (e.g., volleyballs and soccer balls).

Figure 4:
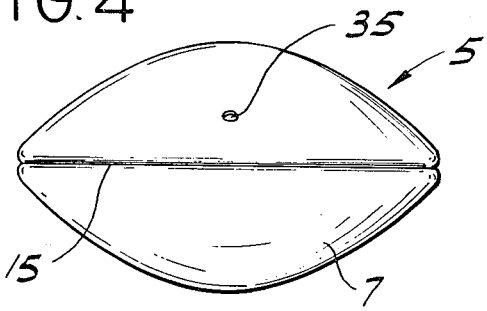
FIG. 4 is a side elevation of a football carcass.
Figure 5:
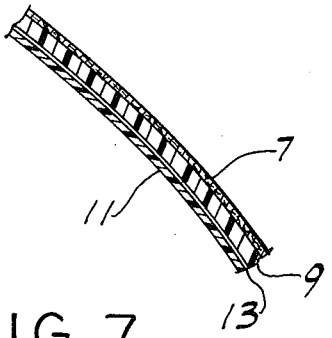
FIG. 5 is an enlarged sectional view showing the wall construction of the carcass.

More specifically, the ball comprises an inner bladder assembly, designated generally by the reference numeral 3, and a hollow outer carcass, generally designated 5, enclosing the bladder assembly. As shown best in FIGS. 4 and 5, the carcass includes an outer cover 7 of relatively tough durable material, such as leather, having a pebbled surface for better gripability and handling, padding 9 on the inside of the cover for making the ball, when fully inflated, softer and more yielding under pressure from the fingers, and a liner 11 on the inside of the padding. The padding may be of polyurethane foam, for example, such as that made by the Poron Division of Rogers Corporation of Connecticut. The liner is of woven fabric, such as twilled nylon, and is preferably about 0.015 in. (0.038 cm.) thick. The outer surface of the liner (i.e., the surface facing the padding) has a thin (e.g., 0.001 in. or 0.0025 cm.) coating 13 thereon which increases the strength of the liner and prevents fraying. This coating may be of polyurethane, for example, of the type sold under the trade designation "Fabuthane" by Fabrite Laminating Corporation of New Jersey. Other types of anti-fray coating material may also be suitable.

The carcass itself is divided into four sections designated 5A–5D, each being generally oval in shape with relatively sharply tapered ends. These sections are seamed together in conventional fashion, e.g., edge-to-edge with the seams 15 toward the interior of the ball as shown in FIG. 2.

The inner bladder assembly 3 comprises an inflatable bladder 17 of conventional construction (two-part molded construction) and of a stretchable substantially air-impervious material such as butyl rubber, and a hollow member or sheath 19 around the bladder for restraining expansion of the bladder when it is inflated. By restraining such expansion, the outward pressure exerted by the bladder on the liner 11 and remainder of the carcass 5 is reduced (but not eliminated), thereby increasing the dimensional stability of the ball (i.e., its ability to retain its shape over a longer period of time). The fact that the sheath reduces the pressure exerted on the inside of the carcass is further advantageous in that this avoids excessive compression of the padding 9 which would reduce its effectiveness in producing a softer more yielding ball.

Figure 6:
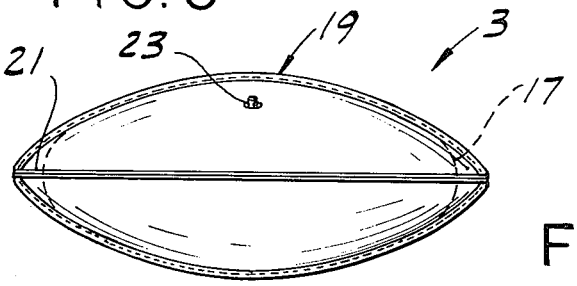
FIG. 6 is a side elevation of a bladder assembly.
Figure 7:
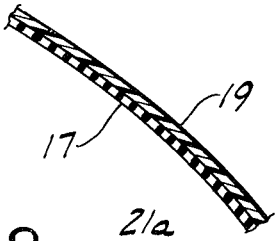
FIG. 7 is an enlarged sectional view showing the wall construction of the bladder assembly.

The material out of which the sheath is made should be a relatively tough material, preferably a synthetic resin, which is stretchable as the bladder is inflated so that it will conform to the inside of the carcass. When inflated to a pressure sufficient to expand the sheath without stretching it (FIG. 6), the bladder assembly 3 is generally of the same shape as the carcass 5 except that it is preferably slightly longer and substantially smaller in girth. When inflated to full playing pressure (about 13 psi in the case of a football) inside the carcass, the bladder and sheath will distend (stretch) girthwise until the sheath substantially conforms to the inside of the carcass. The fact that the ends of the bladder assembly 3 may be somewhat compressed into the ends of the carcass serves to reinforce the ends of the ball and assists in maintaining their tapered shape. When the ball is inflated to its full playing pressure, the sheath should be strong enough to contain a relatively large percentage (but not all) of the pressure forces, so that the net force exerted against the carcass is only about 1–5 psi. It is necessary that at least some force be exerted against the carcass to maintain it taut. It has been found that polyurethane film sold by Tetra Plastics Inc. of St. Louis, Mo. under the designation TP400 has the requisite properties for sheath material. This film has a thickness of about 0.018 in. (0.046 cm.), a Shore A durometer of about 90, a specific gravity of about 1.14, an ultimate tensile strength of about 6250 psi, an ultimate elongation of about 475% and a tear strength of about 540 (using die C pliers). While the caliper of the film is preferably about 0.018 in. (0.046 cm.), it may range from 0.015 in. to 0.022 in. (0.038–0.056 cm.). Other material having the necessary stretch and strength characteristics may also be suitable.

The sheath 19 is formed from a plurality of panels (four panels designated 19A–19D are shown in the drawings), each of which is generally oval in shape with relatively sharply tapered ends. These panels are joined edge-to-edge with adjacent edge margins of adjacent panels seamed (e.g., stitched) together in face-to-face relation to form outwardly projecting seams 21. To inflate the bladder, the latter is provided with a conventional valve nipple 23 which projects outwardly through the sheath and carcass.

To secure the bladder 17 in fixed position with respect to the sheath 19, the area of the bladder around the valve nipple 23 is glued to the inside surface of the sheath. Similarly, to secure the sheath 19 in fixed position with respect to the carcass 5, the area of the sheath around the opening through which the valve nipple projects is glued to the inside of the carcass. Thus when the ball is completely assembled, the bladder, sheath and carcass form a unitary structure.

FIGS. 8–11 illustrate various steps in a method of making a game ball in accordance with this invention. Briefly, the method comprises forming a plurality of sheath panels (e.g., panels 19A–19D), sheathing a bladder (e. g., 17) with the sheath panels, forming a hollow outer carcass (e.g., 5), inserting the sheathed bladder into the carcass through an opening in the carcass, and then closing the opening in the carcass. These steps are described in more detail hereinbelow.

Figure 8:
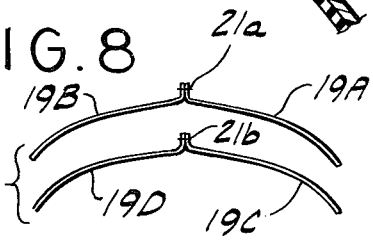
FIG. 8–11 illustrate various steps of a method of the present invention for making the football of FIG. 1.
Figure 9:
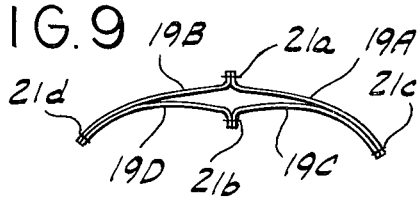
Figure 10:
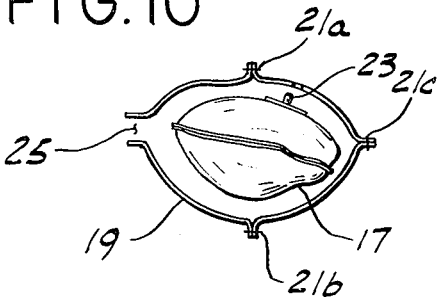

The sheath 19 is made by forming a plurality of sheath panels of the requisite size and shape. When the game ball being made is a football, for example, four panels (e.g., panels 19A–19D) are cut from a web of polyurethane film preferably 0.018 in. (0.046 cm.) thick, each panel being generally oval with relatively sharply tapered ends. These panels are then joined in the manner illustrated in FIGS. 8 and 9. Thus, as depicted in FIG. 8, two of the four panels (designated 19A and 19B) are joined to form one half of the sheath. This is accomplished by seaming adjacent edge margins of the panels together in face-to-face relation to form an outwardly (upwardly) projecting seam 21*a*. The other two panels (designated 19C and 19D) are joined in similar fashion to form the other half of the sheath, the seam formed being indicated at 21*b*. The two sheath halves (each of which is bowl-shaped or dished because of the oval shape of its two component panels) are then nested together as shown in FIG. 9, that is, with the peripheral edge margins of the sheath halves in substantial registry and with the seam of each sheath half projecting away from the other sheath half. The peripheral edge margins of the nested sheath halves are then seamed (e.g., stitched) together in face-to-face relation at 21*c* and 21*d* except at one location to leave an opening 25 in the sheath. A suitable adhesive (e.g., a hot-melt glue) is than applied to the outer surface of a bladder 17 around the valve nipple 23 and the bladder inserted into the sheath through opening 25 to a position in which the valve nipple projects out through a hole 27 in one of the sheath panels (FIG. 10). After the sheath and bladder have been pressed together to set the adhesive, the opening 25 in the sheath is seamed closed to complete the formation of the inner bladder assembly 3. It will be observed that when constructed in this fashion, all four seams 21*a–21d* of the sheath point outwardly away from the bladder, which avoids abrasion of the bladder. The adhesive on the bladder around the valve nipple holds the bladder in fixed position with respect to the sheath.

Figure 11:
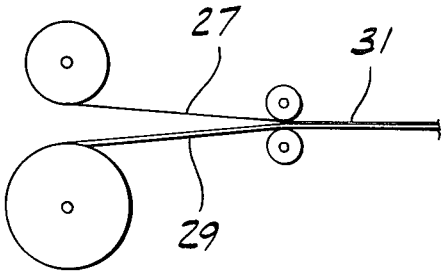

As best illustrated in FIG. 11, the outer carcass 5 of the game ball 1 is formed by combining a web 27 of suitable liner material having a thin, anti-fray polyurethane coating thereon (such as the coating 13 described above), and a web 29 of padding material (e.g., polyurethane foam), with the anti-fray coating facing the padding material. As thus combined, the webs 27, 29 form a liner-pad laminate 31. A plurality of panels of appropiate size and shape are then cut from this laminate.

Assuming that a football carcass is to be made, the panels cut from laminate 31 are ovaloid with relatively sharply tapered ends. Each such panel is joined with a leather cover panel of corresponding size and shape to form a composite panel which constitutes a carcass quarter-section. Four such quarter-sections are then sewn together in conventional fashion to form a hollow football-shaped carcass 5.

After the outer carcass 5 is formed, a suitable adhesive (e.g., a hot-melt glue) is applied to the outer surface of the sheath 19 around the valve nipple 23 and the sheathed bladder inserted into the carcass to a position in which the valve projects through a hole 35 punched in the carcass. After pressing the portion of the sheath around the valve against the inside of the carcass to set the adhesive, the carcass is closed (laced) in the conventional manner. The bladder may then be inflated to expand and stretch the sheath until it substantially conforms to the inside walls of the carcass. As noted hereinabove, the material out of which the sheath 19 is made is sufficiently strong that the force exerted against the inside of the carcass is relatively small (e.g., 1–5 psi in the case of a football) so as not to subject the carcass to excessive internal pressures which would otherwise tend to cause the carcass to lose its shape relatively quickly. Besides restraining the expansion of the bladder and thereby reducing the pressure exerted on the carcass, the sheath also provides some protection against puncture of the bladder.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An inflatable padded game ball comprising:
an inner bladder assembly; and
an outer carcass enclosing the bladder assembly;
said carcass comprising an outer cover of relatively tough durable material, padding on the inside of the cover, and a liner on the inside of the padding;
said inner bladder assembly comprising an inflatable bladder of a substantially air-impervious material, and a sheath around the bladder for restraining expansion of the bladder when it is inflated thereby to reduce the outward pressure on the carcass and thus increase the dimensional stability of the ball.

2. An inflatable padded game ball as set forth in claim 1 wherein the bladder is secured to the sheath.

3. An inflatable padded game ball as set forth in claim 1 wherein said sheath comprises a plurality of panels seamed together edge-to-edge to form a hollow member generally of the same shape as said game ball.

4. An inflatable padded game ball as set forth in claim 3 wherein said game ball is a football and said sheath comprises four generally oval panels with relatively sharply tapered ends seamed together along their edges to form a hollow football-shaped member.

5. An inflatable padded game ball as set forth in claim 3 wherein adjacent edge margins of adjacent sheath panels are seamed together in face-to-face relation with the edge margins projecting away from the bladder to form outwardly projecting seams.

6. An inflatable padded game ball as set forth in claim 1 wherein said sheath, upon inflation of the bladder, is adapted stretchably to expand into engagement with the liner of the outer carcass.

7. An inflatable padded game ball as set forth in claim 6 wherein said sheath is strong enough to contain a relatively large percentage of, but not all of, the full playing pressure of the ball, so that the net outward pressure exerted against the carcass is substantially reduced.

8. An inflatable padded game ball as set forth in claim 7 wherein said sheath has a wall thickness of 0.015–0.022 in. (0.038–0.056 cm.).

9. An inflatable padded game ball as set forth in claim 8 wherein said sheath has a wall thickness of about 0.018 in. (0.046 cm.)

10. An inflatable padded game ball as set forth in claim 8 wherein said sheath is of a synthetic resin material.

11. An inflatable padded game ball as set forth in claim 1 wherein said bladder has a valve member projecting outwardly therefrom through an opening in the sheath.

12. An inflatable padded game ball as set forth in claim 1 wherein the liner is of woven material and treated to prevent fraying of the liner.

13. An inflatable padded game ball as set forth in claim 12 wherein said liner has a coating of polyurethane thereon to prevent fraying of the liner.

14. An inflatable padded game ball as set forth in claim 1 wherein said padding is of polyurethane foam material.

15. A method of making a padded game ball of the type comprising an inflatable bladder of substantially air-impervious material, a sheath around the bladder for limiting expansion of the bladder when it is inflated, and an outer carcass enclosing the sheathed bladder, said method comprising:
forming a plurality of sheath panels;
sheathing the bladder with said sheath panels;
forming a hollow outer carcass;
inserting the sheathed bladder into the carcass through an opening in the carcass; and
closing the opening in the carcass.

16. A method as set forth in claim 15 wherein said sheathing step comprises joining said sheath panels to form a hollow sheath for the bladder, said sheath having generally the same shape as said game ball.

17. A method as set forth in claim 16 wherein said sheath panels are joined by seaming adjacent edge margins of adjacent sheath panels in face-to-face relation to form outwardly projecting seams.

18. A method as set forth in claim 17 for making a padded football, said sheath-forming step comprising forming four sheath panels, each being generally oval in shape with relatively sharply tapered ends.

19. A method as set forth in claim 18 wherein said seaming step comprises seaming together two of the four panels to form one half of the sheath, seaming together the other two panels to form the other half of the sheath, nesting the sheath halves together with their peripheral edge margins in substantial registry and with the seam of each sheath half projecting away from the other sheath half, and seaming together the peripheral edge margins of the nested sheath halves to form the sheath.

20. A method as set forth in claim 17 wherein said sheath panels are seamed together along their edges except at one location to provide an opening in the sheath, said sheathing step further comprising inserting the bladder into the sheath through the opening and then seaming the opening closed.

21. A method as set forth in claim 20 further comprising securing said bladder in fixed position within the sheath prior to closing said opening.

22. A method as set forth in claim 15 further comprising inflating the bladder after it has been sheathed and inserted into the carcass stretchably to expand the sheath outwardly into engagement with the inside of the carcass.

* * * * *